United States Patent [19]

Stoev et al.

[11] 3,997,436

[45] Dec. 14, 1976

[54] APPARATUS FOR CLEANING FLOCCULATED SLIME AND OTHER MATERIAL

[75] Inventors: Stoycho Mitrev Stoev; Roza Tzvetanova Kintisheva, both of Sofia, Bulgaria

[73] Assignee: Vish Minno-Geoloshki Institute-Nis, Sofia, Bulgaria

[22] Filed: June 10, 1975

[21] Appl. No.: 585,530

[52] U.S. Cl. ..... 209/426; 209/157; 210/523; 210/DIG. 18; 210/DIG. 22

[51] Int. Cl.[2] ..... B03B 5/12; B03B 5/22

[58] Field of Search ..... 210/19, 83, 84, 523, 210/DIG. 18, DIG. 22; 209/5, 17, 150, 158, 159, 160, 161, 157, 426

[56] References Cited

UNITED STATES PATENTS

| | | | |
|---|---|---|---|
| 907,387 | 7/1905 | Merrill | 209/160 |
| 1,456,563 | 5/1923 | Noriega | 209/161 |
| 1,959,212 | 5/1934 | Miller | 209/158 |
| 2,025,412 | 12/1935 | Handy | 209/161 |
| 2,074,085 | 3/1967 | Frantz | 210/DIG. 18 |
| 2,729,330 | 1/1956 | Newirth | 209/150 |
| 2,829,735 | 4/1958 | Kroll | 210/DIG. 18 |
| 2,854,136 | 9/1958 | Gillie | 209/158 |
| 2,967,617 | 1/1961 | Evans | 209/158 |
| 3,310,242 | 3/1967 | Perkins | 209/17 |

FOREIGN PATENTS OR APPLICATIONS

| | | | |
|---|---|---|---|
| 914,207 | 11/1958 | United Kingdom | 209/158 |

OTHER PUBLICATIONS

Friend, Kitchener, "The Separation of Minerals from Mixtures by Selective Flocculation, Filtration & Separation", Feb. 1972, 25–28.

*Primary Examiner*—Charles N. Hart
*Assistant Examiner*—Ernest G. Therkorn

[57] ABSTRACT

Flocculated slime to be cleaned is introduced into the top of a vertically disposed, conical precipitator having at its bottom a discharge orifice. The introduced slime flows downwardly through an apertured plate mounted substantially horizontally in the precipitator. The plate is mechanically vibrated at a frequency in the range 20–100 Hz and an amplitude in the range 0.5–1.5 mm as the slime flows therethrough to liberate impurities mechanically trapped in the slime.

3 Claims, 1 Drawing Figure

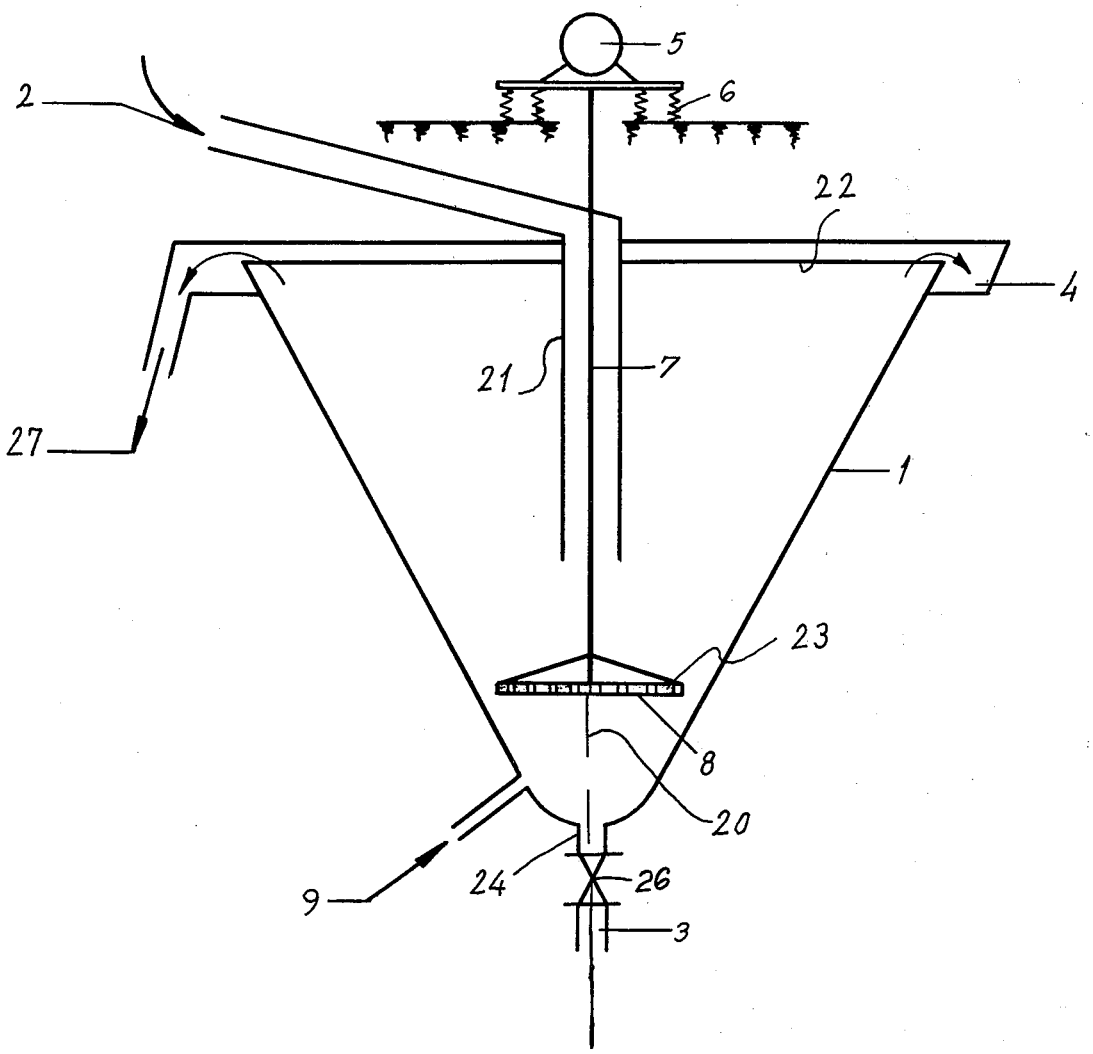
5
6
2
22
4
21
7
27
1
23
8
20
9
24
26
3

APPARATUS FOR CLEANING FLOCCULATED SLIME AND OTHER MATERIAL

BACKGROUND OF THE INVENTION

Various methods are known for cleaning flocculated slime and other material by liberating mechanically trapped impurities therefrom. In one such known method, the slime is exposed to a downwardly flowing water stream.

Such technique has the disadvantage of excessively increasing the moisture content of the flocculated slime, so that the material must undergo an additional partial drying step. Additionally, it has been found that the water stream is incapable of dislodging all the trapped impurities, while turbulence in the water stream compounds the problem. Also, the waste water resulting from the treatment represents a form of environmental pollution.

SUMMARY OF THE INVENTION

Such problems are overcome with the apparatus of the invention for cleaning flocculated material such as slime. In an illustrative technique, the flocculated slime is flowed downwardly through a conical precipitator, and during its downward flow the slime is mechanically vibrated at a frequency in the range of 20–100 Hz and an amplitude in the range of 0.5–1.5 mm in a localized region of the chamber. Such mechanical vibration serves to dislodge the mechanically entrapped impurities, while the resulting sediment is compacted by the vibration to avoid the accumulation of an excess moisture content.

The cleaned sediment is discharged from the bottom of the precipitating chamber, while the dislodged impurities overflow into an annular chute disposed around and in contact with the top rim of the precipitator.

The required mechanical vibration within the precipitator is accomplished by means of a horizontally supported apertured plate disposed within the precipitator in the path of the downward flow of slime. The plate is coupled, via a vertical connecting rod, to a resiliently mounted mechanical vibrator disposed above the top rim of the precipitator.

BRIEF DESCRIPTION OF THE DRAWING

The invention is further set forth in the following detailed description taken in conjunction with the appended drawing, in which the single FIGURE illustrates an elevation view of a conical precipitator having facilities for cleaning flocculated slime in accordance with the invention.

DETAILED DESCRIPTION

Referring now to the drawing, flocculated slime or other material to be cleaned in accordance with the invention is conducted via an inlet pipe 2 to the top portion of a conical precipitator 1 having a vertical axis 20. The pipe 2 has a section 21 that extends downwardly through a top rim 22 of the precipitator 1 to terminate coaxially in the precipitator 1, and thereby introduce the slime therein in a substantially downward flow.

Disposed below the outlet end of the pipe portion 21 is a plate 8 having a plurality of apertures 23—23 therein. The downwardly flowing slime passes through the apertures 23 in the plate while the latter is mechanically vibrated as indicated below, and the sediment transmitted through the plate 8 is discharged from the apparatus via an outlet port 24 of the precipitator, such outlet port communicating with a discharge pipe 3 via a suitable valve 26. Impurities which are freed from the incoming slime by means of the vibration of the plate 8 are propelled to the top of the precipitator 1 with the aid of water introduced via a pipe 9 near the bottom of the apparatus. An annular chute 4 is disposed around and in contact with the top rim 22 of the precipitator 1 in order to receive an overflow of the water-borne freed impurities from the slime, such chute 4 overflowing into an impurity discharge pipe 27.

The apertured plate 8 is vibrated mechanically at a frequency in the range of 20–100 Hz and an amplitude in the range of 0.5–1.5 mm by means of a suitable mechanical oscillator 5 resiliently mounted above the top rim 22 of the precipitator 1. The oscillator 5 is connected to ground or other suitable support structure via springs 6—6.

A rod 7 extends between the oscillator 5 and the plate 8 to support the plate in its horizontal position shown and to couple the mechanical vibrations of the oscillator 5 to the plate.

In the operation of the apparatus of the drawing, the slime introduced into the pipe 2 flows downwardly via the pipe section 21 and through the apertures 23 in the plate 8 while the plate 8 is vibrated mechanically by the oscillator 5 in the frequency and amplitude range indicated above. Such vibration of the flowing slime has been found to liberate the entrapped impurities, which travel to the top of the precipitator 1 along with water from the pipe 9. The cleaned flocculated sediment passing through the apertures 23 is compacted by the vibration, so that such sediment is not overly susceptible to absorption of water entering the apparatus via the pipe 9. The cleaned sediment exits via outlet port 24, valve 26 and discharge pipe 3.

When the water-borne freed impurities reach the top rim 22, they overflow into the chute 4 and are discharged therefrom via pipe 27.

When the technique and apparatus of the invention as just described was applied to a fluorite-containing slime, it was found that the calcium fluorite content in the flocculated material increased by 13.2%, while the quartz and clay contents in the incoming slime were decreased by 4.3 and 1.5%, respectively.

In the foregoing, the invention has been described in connection with one illustrative technique thereof. Many variations and modifications will now occur to those skilled in the art. It is accordingly desired that the scope of the appended claims not be limited to the specific disclosure herein contained.

What is claimed is:

1. In an apparatus for cleaning flocculated material in the form of a liquid-borne suspension, a conical precipitator having a vertical axis and a bottom outlet, first inlet pipe means disposed at the upper end of the precipitator for introducing the liquid-borne material into the precipitator to flow downwardly therein, an apertured plate supported substantially horizontally in the flow path between said first inlet and said bottom outlet, a discharge pipe communicating with the bottom outlet of the precipitator, an annular chute coupled to and disposed around the top rim of the precipitator, second inlet pipe means disposed in the lower portion of the precipitator for introducing liquid therein, and means for mechanically vibrating the plate at a specified rate.

2. Apparatus as defined in claim 1, in which the vibrating means include means for oscillating the plate with a frequency in the range of 20–100 Hz and an amplitude in the range of 0.5–1.5 mm.

3. Apparatus as defined in claim 1, in which the vibrating means comprises, in combination, a mechanical oscillator resiliently supported above the top rim of the precipitator, and a connecting rod extending downwardly through the axis of the precipitator between the vibrator and the plate.

* * * * *